US009412538B2

(12) United States Patent
Fukunaga

(10) Patent No.: US 9,412,538 B2
(45) Date of Patent: Aug. 9, 2016

(54) ROTARY OPERATION TYPE ELECTRONIC COMPONENT

(71) Applicant: TOKYO COSMOS ELECTRIC CO., LTD., Kanagawa (JP)
(72) Inventor: Taro Fukunaga, Kanagawa (JP)
(73) Assignee: TOKYO COSMOS ELECTRIC CO., LTD., Kanagawa (JP)

( * ) Notice: Subject to any disclaimer, the term of this patent is extended or adjusted under 35 U.S.C. 154(b) by 0 days.
(21) Appl. No.: 14/438,391
(22) PCT Filed: Nov. 6, 2013
(86) PCT No.: PCT/JP2013/079982
§ 371 (c)(1),
(2) Date: Apr. 24, 2015
(87) PCT Pub. No.: WO2014/087783
PCT Pub. Date: Jun. 12, 2014
(65) Prior Publication Data
US 2015/0287557 A1 Oct. 8, 2015
(30) Foreign Application Priority Data
Dec. 7, 2012 (JP) ..... 2012-267990
(51) Int. Cl.
*H01H 19/20* (2006.01)
*H01C 10/14* (2006.01)
(Continued)
(52) U.S. Cl.
CPC ..... *H01H 19/20* (2013.01); *H01C 10/14* (2013.01); *H01C 10/46* (2013.01); *H01H 3/08* (2013.01); *H01H 3/10* (2013.01); *H01H 19/585* (2013.01)
(58) Field of Classification Search
CPC ..... H01H 19/20; H01H 3/10; H01H 19/585; H01H 3/08; H01C 10/14; H01C 10/46
USPC ..... 200/283, 11 A, 564–565, 7, 6 R, 17 R, 200/19.03, 19.07, 19.18, 570, 316, 336, 200/450, 520–521
See application file for complete search history.

(56) References Cited

U.S. PATENT DOCUMENTS 5,669,489 A * 9/1997 von Ende ..... G01D 5/25 200/11 R
6,175,091 B1 * 1/2001 Nishimura ..... H01H 19/585 200/11 R (Continued)

FOREIGN PATENT DOCUMENTS

JP 4-20201 2/1992
JP 8-181006 7/1996

(Continued)

OTHER PUBLICATIONS

International Search Report for PCT/JP2013/079982 with English-language Translation having a mailing date of Feb. 4, 2014.

*Primary Examiner* — Edwin A. Leon
(74) *Attorney, Agent, or Firm* — Greenblum & Berstein, P.L.C.

(57) ABSTRACT

An easy-to-design rotary operation type electronic component is provided. The component includes a columnar control shaft; a shaft supporter having a circular through shaft hole; an electrical signal control section which is attached to one end of the shaft supporter and allows an electrical signal to be controlled by rotary operation of the control shaft; and a cylindrical spring which is held in a spring holding space formed between the outer periphery of the control shaft and the inner periphery of the through shaft hole, and has a ring shape with an opening cut in the direction of the central axis. The cylindrical spring includes a plurality of leaf spring portions which extend in the direction of the central axis of the control shaft, are connected together in the circumferential direction of the control shaft, and are arranged on the outer periphery of the control shaft.

12 Claims, 7 Drawing Sheets

(51) Int. Cl.

| | |
|---|---|
| ***H01C 10/46*** | (2006.01) |
| ***H01H 3/08*** | (2006.01) |
| *H01H 19/58* | (2006.01) |
| *H01H 3/10* | (2006.01) |

(56) References Cited

U.S. PATENT DOCUMENTS 6,570,105 B1 * 5/2003 Sallam ..... H01H 25/06 200/1 R
8,084,703 B2 * 12/2011 Hisamune ..... H01H 19/14 200/336
8,766,121 B2 * 7/2014 Mahida ..... G05G 5/06 200/336

FOREIGN PATENT DOCUMENTS

JP 11-329806 11/1999
JP 2003-115237 4/2003

* cited by examiner

20

20

ROTARY OPERATION TYPE ELECTRONIC COMPONENT

TECHNICAL FIELD

The present invention relates to rotary operation type electronic components which are used mainly in portable electronic devices and allow the electrical resistance between terminals to be changed or allow electrical connection between terminals to be switched by rotation of a control shaft.

BACKGROUND ART

Rotary switches or rotary variable resistors (these components will be collectively referred to as rotary operation type electronic components) used, for example, in portable electronic devices may be operated by a gloved hand or in an environment where it is difficult to work with precision. Those portable electronic devices are accordingly required to have rotary operation type electronic components having a large rotary-operation knob for easier operation. The larger the operation knob becomes, however, the more the operation torque is applied to the control shaft. Therefore, an erroneous operation is likely to happen if the operation knob is turned excessively, or is turned unintentionally due to an unexpected force from the outside or when the operator is startled by a sudden sound or light. Rotary operation type electronic components reduced in size for miniaturized portable electronic devices have naturally reduced the operation torque required for rotary operation and have the problem of increasing the possibility of similar erroneous operation. Accordingly, a rotary operation type electronic component that requires a large torque for the turning operation is proposed in Patent literature 1.

FIG. 1 shows a sectional view of the rotary operation type electronic component disclosed in Patent literature 1, in which a thin resilient metal sheet 300 folded into a polygon (hereafter referred to as a polygonal leaf spring) is placed between the inner periphery of a through shaft hole 100*a* formed in a shaft supporter 100 and the outer periphery of a control shaft 200 inserted into the through shaft hole 100*a*. The polygonal leaf spring 300 is held in such a bent state that the center of each folded side is pressed radially outward by the outer periphery of the control shaft 200. When the control shaft 200 is going to be turned, a sliding frictional force is generated between the leaf spring 300 and the control shaft 200 and an amount of torque corresponding thereto is needed for the turning operation. By placing such a type of polygonal leaf spring 300 to increase the torque needed for the turning operation, the possibility of erroneous operation can be reduced.

PRIOR ART LITERATURE

Patent Literature

Patent literature 1: Japanese Patent Application Laid Open No. H11-329806

SUMMARY OF THE INVENTION

Problems to be Solved by the Invention

In the structure disclosed in Patent literature 1 as shown in FIG. 1, the amount of bending of each folded side must be increased to increase the operation torque, but the largest possible amount of bending (clearance that ensures the amount of bending) is structurally limited to $r(1-\cos \pi/N)$, where the inside diameter of the through shaft hole 100*a* is 2r, and the number of folded corners of the polygonal leaf spring 300 is N (the thickness of the leaf spring is ignored, and both ends of the polygonal leaf spring are considered to be connected to each other, forming a single folded corner), meaning that N must be reduced to increase the clearance. If N is reduced, the number of positions at which the polygonal leaf spring 300 and the control shaft 200 are in contact with each other decreases, increasing friction correspondingly at each of the positions where the leaf spring is in contact. If N is increased to decrease friction, the length of each folded side of the leaf spring is reduced correspondingly, and a slight change in the amount of bending would vary the operation torque greatly, so that the amount of bending of a folded side must be specified with a higher precision in order to obtain a desired torque. These problems make it difficult to manufacture small rotary operation type electronic components.

An object of the present invention is to provide a rotary operation type electronic component that can be designed and manufactured more easily than conventional ones.

Means to Solve the Problems

To solve the above-described problems, a rotary operation type electronic component according to the present invention includes a columnar control shaft; a shaft supporter having a circular through shaft hole into which the control shaft is inserted; an electrical signal control section which is attached to one end of the shaft supporter and allows an electrical signal to be controlled by rotary operation of the control shaft; and a cylindrical spring which is held to encircle the outer periphery of the control shaft, in a ring-shaped spring holding space formed between the outer periphery of the control shaft and the inner periphery of the through shaft hole, and has a ring shape with an opening cut in the direction of the central axis. The cylindrical spring includes a plurality of leaf spring portions which extend in the direction of the central axis of the control shaft, are connected together in the circumferential direction of the control shaft, and are arranged on the outer periphery of the control shaft. The plurality of leaf spring portions have curved projection portions formed by curving their central areas in the length direction to project toward the same side, which is the radially inner or outer side of the cylindrical spring, are placed resiliently between the outer periphery of the control shaft and the inner periphery of the through shaft hole, and are given radially opposite pressing forces at both end portions of the leaf spring portions and the curved projection portions.

Effects of the Invention

Since the number of cylindrically arranged leaf spring portions and the largest amount of bending of the leaf spring portions can be specified independently of each other according to the present invention, it becomes easy to design rotary operation type electronic components and it becomes possible to reduce the size of those components.

DETAILED DESCRIPTION OF THE EMBODIMENTS

Now, an embodiment of the present invention will be described in detail.

[Embodiment]

Figure 1:
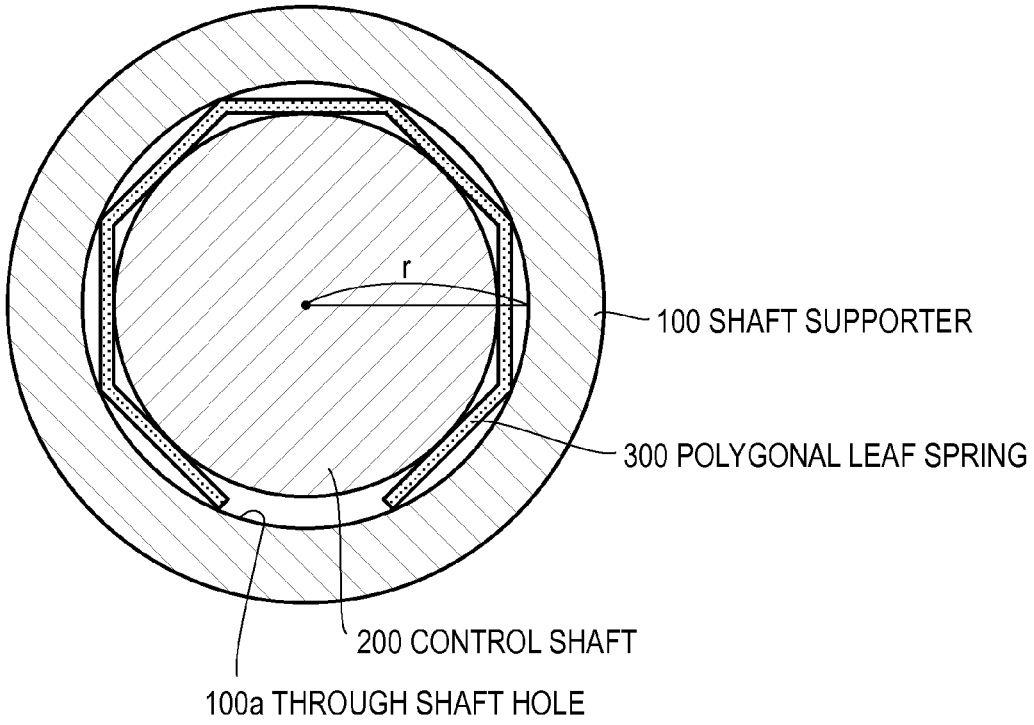
FIG. 1 is a sectional view of a rotary operation type electronic component disclosed in Patent literature 1.
Figure 2:
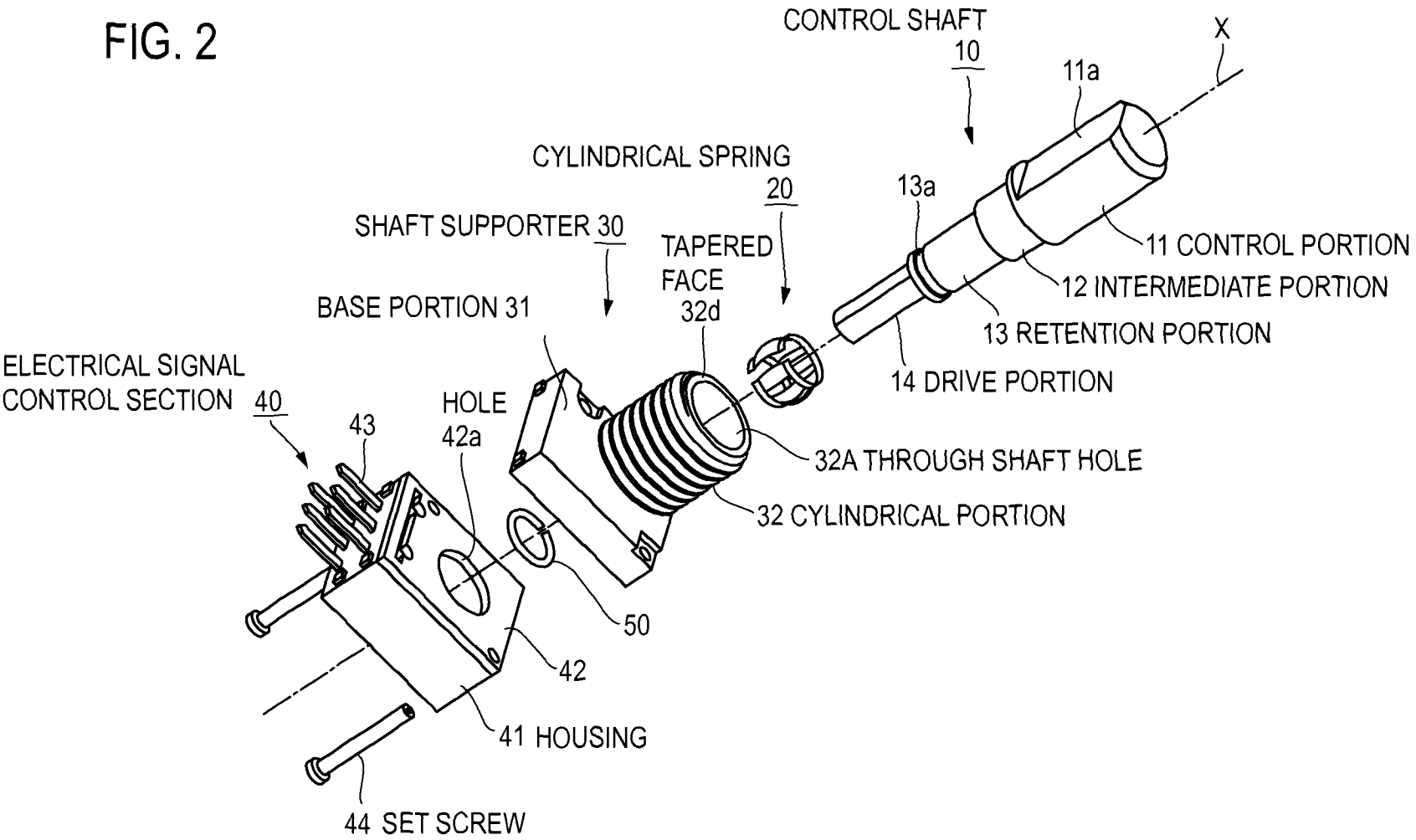
FIG. 2 is an exploded perspective view of a rotary operation type electronic component according to an embodiment of the present invention.
Figure 3:
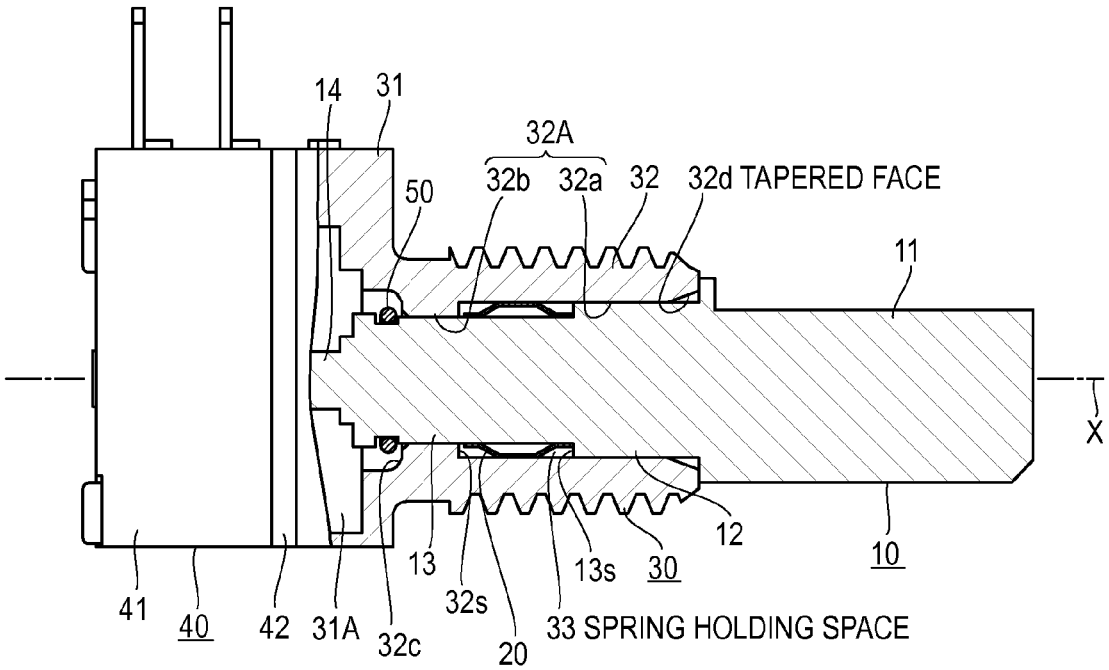
FIG. 3 is a partial sectional view of the rotary operation type electronic component according to the embodiment of the present invention.

FIG. 2 is a perspective view of a rotary operation type electronic component according to the present invention, showing parts separated and arranged in the direction of the central axis X, and FIG. 3 is a partial sectional view of an assembled rotary operation type electronic component along the central axis X. The rotary operation type electronic component of the present invention includes a columnar control shaft 10 made of metal, a cylindrical spring 20 which is formed by a metal sheet having spring characteristics and which has a ring shape with an opening cut in the direction of the axis, a shaft supporter 30 made of metal or resin, an electrical signal control section 40, and a retaining ring 50 which is made of metal and which has an opening cut.

The columnar control shaft 10 includes a columnar control portion 11 with a flat face 11*a* formed by cutting off a portion of a desired length parallel to the central axis X, a columnar intermediate portion 12 extended coaxially from the control portion 11 and having a smaller diameter, a columnar retention portion 13 extended coaxially from the intermediate portion 12, having a further smaller diameter, and having the cylindrical spring 20 around it, and a columnar drive portion 14 extended coaxially from the retention portion 13 and having a further smaller diameter. A step 13*s* is formed on the boundary between the intermediate portion 12 and the retention portion 13.

The retention portion 13 has a ring-shaped groove 13*a* formed for the retaining ring 50 to be put on the outer periphery, near the edge on the side of the drive portion. The drive portion 14 has cut faces formed parallel to each other and parallel to the central axis X on both sides of the central axis X and engages with a turning mechanism, which is not shown in the figures, in a housing 41. With the flat faces 11*a* formed on the control portion 11, the relative rotational position of the mounting hole of an operation knob, which is not shown in the figures, to be mounted on the control portion 11 can be determined.

Figure 4A:
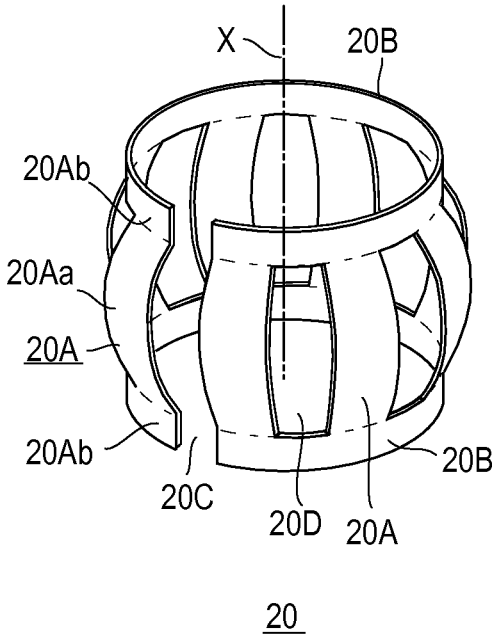
FIG. 4A is a perspective view of a cylindrical spring used in the rotary operation type electronic component of the present invention.

The cylindrical spring 20 has a plurality of rectangular leaf spring portions 20A that are arranged at intervals in the circumferential direction on the periphery of a hidden virtual column, as shown in FIG. 4A, for example, and that extend in the direction of the central axis X, and two connecting bands 20B that connect the leaf spring portions 20A at both ends in the circumferential direction. The central area in the direction of the central axis X of each of the leaf spring portions 20A is curved to project radially outward, forming a curved projection portion 20Aa. The connecting bands 20B are separated between one pair of adjacent leaf spring portions 20A among the plurality of rectangular leaf spring portions 20A, forming an opening 20C.

The shaft supporter 30 includes a base portion 31 having a square block shape and a cylindrical portion 32 rising at a right angle from the front face of the base portion. The cylindrical portion 32 has a circular through shaft hole 32A around the central axis X, and a tapered face 32*d* the diameter of which increases outward is formed at the tip of the through shaft hole 32A. The through shaft hole 32A is formed at the tip of the cylindrical portion 32 and has a large-diameter shaft hole portion 32*a* the inside diameter of which is larger than the inside diameter of the area into which the intermediate portion 12 of the control shaft 10 is inserted so as to fit, or the outside diameter of the intermediate portion 12, and a small-diameter shaft hole portion 32*b* with a further smaller inside diameter, into which the retention portion 13 of the control shaft 10 is inserted so as to fit, the inside diameter being larger than the outside diameter of the retention portion 13 and smaller than the outside diameter of the intermediate portion 12, and a step 32*s* is formed on the boundary between the large-diameter shaft hole portion 32*a* and the small-diameter shaft hole portion 32*b*. The back end of the small-diameter shaft hole portion 32*b* is placed next to the edge of the ring-shaped groove 13*a* on the side of the intermediate portion 12 in the state in which the control shaft 10 is attached to the shaft supporter 30, and the inside diameter of the through shaft hole 32A is enlarged from the back end of the small-diameter shaft hole portion 32*b* and provides an enlarged shaft hole portion 32*c*. In the base portion 31, a connection space 31A is formed for connection to the back face, by enlarging the enlarged shaft hole portion 32*c* further. The length of the intermediate portion 12 in the direction of the central axis X is smaller than the length of the large-diameter shaft hole portion 32*a* in the direction of the central axis X, and a ring-shaped spring holding space 33 is formed between the inner periphery of the large-diameter shaft hole portion 32*a* and the outer periphery of the intermediate portion 12 in the state in which the control shaft 10 is inserted deepest into the through shaft hole 32A.

The electrical signal control section 40 has a rectangular parallelepiped shape that includes a single face matching with the quadrilateral back face of the base portion 31, and includes the housing 41, which includes a variable resistor or a switch that is turned and driven by the drive portion 14, a cover 42 that covers the opening of the housing, terminals 43 where electrical signals are input and output, and set screws 44 that secure the housing 41 to the base portion 31. The cover 42 has a hole 42*a* from which the drive portion 14 is inserted into the housing 41. An example of a rotary operation type electronic component having a switch as the electrical signal control section 40 is disclosed, for example, in Japanese Patent Application Laid Open No. 2010-218883. Examples of rotary operation type electronic components having a variable resistor as the electrical signal control section 40 are disclosed, for example, in Japanese Patent Application Laid Open No. 2010-186792 or Japanese Patent Application Laid Open No. 2006-147832. As an example of the electrical signal control section 40, an angle sensor using a magnet and a magnetic sensor that can be turned relatively is disclosed in Japanese Patent Application Laid Open No. H8-236314.

The control shaft 10 is locked to the shaft supporter 30 when the ring-shaped groove 13*a* of the retention portion 13 is placed next to and outside the small-diameter shaft hole portion 32*b* and the retaining ring 50 is attached to the ring-shaped groove 13*a*, in the state in which the cylindrical spring 20 shown in FIG. 4A is mounted to the outer periphery of the retention portion 13 of the control shaft 10 and the control shaft 10 is inserted into the shaft supporter 30. In that locked state, the spring holding space 33 is formed between the outer periphery of the retention portion 13 and the inner periphery of the large-diameter shaft hole portion 32*a*, and the position of the step 13*s* of the control shaft 10 in the direction of the central axis X and the position of the step 32*s* of the through shaft hole 32A in the direction of the central axis X are determined such that the length of the space in the direction of the central axis X becomes greater than the length of the cylindrical spring 20 stretched flatways in the direction of the central axis X. The drive portion 14 of the control shaft 10 enters the housing 41 of the electrical signal control section 40 through the connection space 31A in the base portion 31 of the shaft supporter 30.

The cylindrical spring 20 is formed as described below. By forming at regular intervals, in a rectangular metal sheet having spring characteristics, an array of rectangular slits 20D long in the direction of the shorter side of the metal sheet (hereafter width direction) and parallel to one another, a plurality of rectangular leaf spring portions 20A connected by two connecting bands 20B at both ends are formed. All the leaf spring portions 20A are pressed together to be curved so that the central areas of the leaf spring portions 20A in their length direction project to the same side with respect to the face of the original metal sheet. The cylindrical spring 20 is obtained by rolling the two connecting bands 20B connecting the leaf spring portions 20A in a direction such that the curved areas project radially outward, until the leaf spring portions 20A located at both ends of the array of leaf spring portions 20A connected by the two connecting bands 20B become next to each other.

The connecting bands 20B serve as both end portions 20Ab of the leaf spring portions 20A. The ends of the leaf spring portions act as fulcrums, and the curved projecting central areas act as points of application.

Since the minimum inside diameter of the cylindrical spring 20 (inside diameter of the connecting bands 20B) in a free state is set smaller than the outside diameter of the retention portion 13, when the cylindrical spring 20 is mounted to the retention portion 13, the opening 20C between the adjacent leaf spring portions 20A in both ends of the array is widened resiliently, and the cylindrical spring 20 is held onto the retention portion 13 by the spring force. It is designed that the maximum outside diameter (outside diameter in the central areas of the leaf spring portions 20A) of the cylindrical spring 20 in that state becomes larger than the inside diameter of the large-diameter shaft hole portion 32*a* of the through shaft hole 32A. Accordingly, when the control shaft 10 with the cylindrical spring 20 mounted thereto is inserted into the shaft supporter 30, the leaf spring portions 20A are deformed resiliently so as to be pressed radially inward by the inner periphery of the large-diameter shaft hole portion 32*a* such that the radial height of the leaf spring portions 20A with respect to the retention portion 13 is lowered toward the central axis X, and so as to have an increased length of the leaf spring portions 20A in the direction of the central axis X. This exerts radially opposite pressing forces on the curved projection portions 20Aa and the both end portions 20Ab of the leaf spring portions 20A, generating pressure P1 between the curved projection portions 20Aa forming the outer periphery of the leaf spring portions 20A and the inner periphery of the through shaft hole 32A and pressure P2 between the inner periphery of the connecting bands 20B forming the both end portions 20Ab of the leaf spring portions 20A and the outer periphery of the retention portion 13. Since the latter pressure P2 includes a pressure at which the cylindrical spring 20 holds the retention portion 13 resiliently, P1<P2. The connecting bands 20B are deformed in a ring shape so that the surface of the inner periphery contracts, and the contraction increases the roughness of the surface. On the other hand, the surface of the outer periphery of the leaf spring portions 20A is curved and expanded, decreasing the surface roughness. As a result, the static frictional force between the leaf spring portions 20A and the inner periphery of the through shaft hole 32A becomes smaller than the static frictional force between the connecting bands 20B and the outer periphery of the retention portion 13. When the control shaft 10 is rotated, the cylindrical spring 20 rotates together with the control shaft 10 (that is, the cylindrical spring 20 does not rotate relatively with respect to the control shaft 10) while rotating slidably on the inner periphery of the through shaft hole 32A.

To increase the torque needed for the turning operation, the friction between the cylindrical spring 20 and the shaft supporter 30 should be increased. According to the present invention, the friction can be increased easily by increasing the number of leaf spring portions 20A in the cylindrical spring 20 and by increasing the largest possible amount of resilient displacement of the leaf spring portions 20A (height of the curves of the leaf spring portions 20A). Since the number of leaf spring portions 20A and the possible amount of displacement can be selected independently of each other, the high degree of freedom in design makes it easy to design and manufacture small rotary operation type electronic components.

[Modifications on Cylindrical Spring]

Figure 4B:
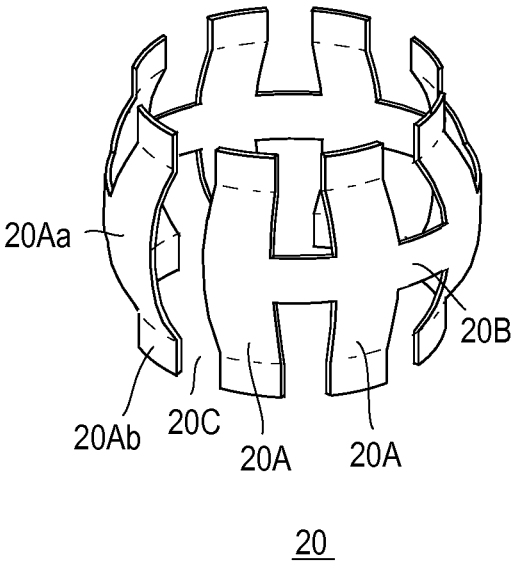
FIG. 4B is a perspective view showing a first modification of the cylindrical spring.

FIG. 4B shows a first modification of the cylindrical spring 20 in the embodiment shown in FIGS. 2 and 3. This modification differs from the one shown in FIG. 4A in the following points: A connecting band 20B is formed by connecting the curved, projecting central areas of leaf spring portions 20A; and the both end portions 20Ab of each of the leaf spring portions 20A are separated from the both end portions 20Ab of adjacent leaf spring portions 20A.

Figure 4C:
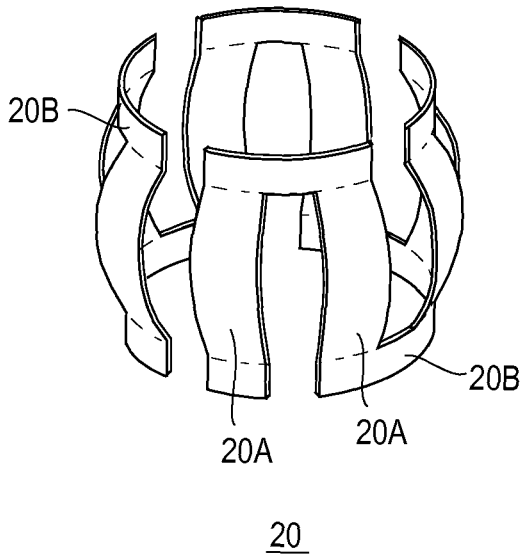
FIG. 4C is a perspective view showing a second modification of the cylindrical spring.

FIG. 4C shows a second modification of the cylindrical spring 20, which differs from the one shown in FIG. 4A in the following structure: The connecting bands 20B are cut off, at one end between one pair of two adjacent leaf spring portions 20A, from every second pair of two adjacent leaf spring portions in the circumferential direction and are cut off, at another end between the next pair of two adjacent leaf spring portions 20A, from every second pair of two adjacent leaf spring portions in the circumferential direction. In other words, each of the leaf spring portions 20A is connected to an adjacent leaf spring portion by the connecting band 20B alternately at one end or another in the circumferential direction.

Figure 4D:
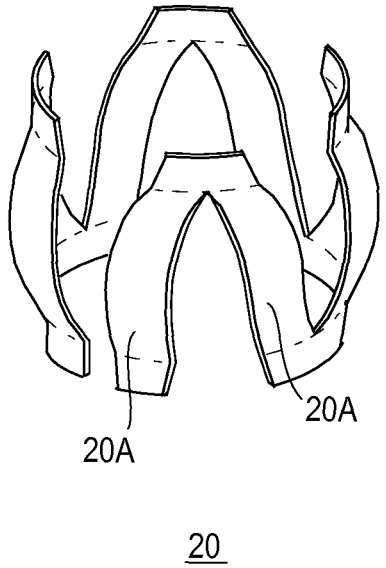
FIG. 4D is a perspective view showing a third modification of the cylindrical spring.

FIG. 4D shows a third modification of the cylindrical spring 20. This modification differs from the one shown in FIG. 4C in the following points: The leaf spring portions 20A are placed diagonally with respect to the direction of the central axis X so that adjacent leaf spring portions 20A form V shapes; the adjacent leaf spring portions 20A are connected at one end or another directly, not by the connecting band 20B.

In the embodiment using the cylindrical spring 20 as shown in FIG. 4A, described with reference to FIGS. 2 and 3, the cylindrical spring 20 does not rotate relatively with respect to the control shaft 10 but rotates slidably on the shaft supporter 30, but on the contrary, the cylindrical spring 20 may not rotate relatively with respect to the shaft supporter 30 and may rotate slidably on the control shaft 10. This configuration can be implemented by forming fine irregularities on the curved faces of the radially outward projections of the leaf spring portions 20A of the cylindrical spring 20 to increase the surface roughness, thereby increasing the frictional force between the cylindrical spring 20 and the inner periphery of the through shaft hole 32A to exceed the frictional force between the cylindrical spring 20 and the control shaft 10. The same applies to the modifications shown in FIGS. 4B to 4D.

Figure 5A:
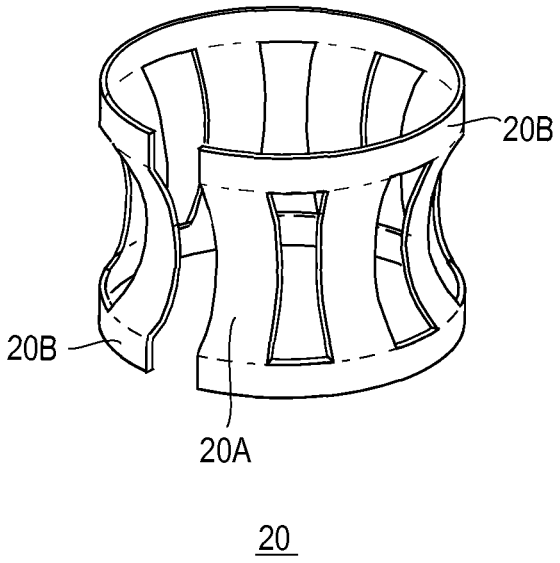
FIG. 5A is a perspective view showing a fourth modification of the cylindrical spring.

FIG. 5A shows a fourth modification of the cylindrical spring 20. This modification differs from the cylindrical spring 20 shown in FIG. 4A in that the central areas of the leaf spring portions 20A of the cylindrical spring 20 are curved to project radially inward, contrary to the ones shown in FIG. 4A. The rotary operation type electronic component using this modification of the spring is assembled by first placing the cylindrical spring 20 in the large-diameter shaft hole portion 32*a* of the shaft supporter 30 and then putting the control shaft 10 into the through shaft hole 32A of the shaft supporter 30 so that the retention portion 13 of the control shaft 10 is inserted into the cylindrical spring 20. Accordingly, the outer peripheries of the connecting bands 20B of the cylindrical spring 20 resiliently come into contact with the inner periphery of the large-diameter shaft hole portion 32*a* of the shaft supporter 30, and the curved projection portions 20Aa resiliently come into contact with the outer periphery of the retention portion 13 of the control shaft 10.

Figure 5B:
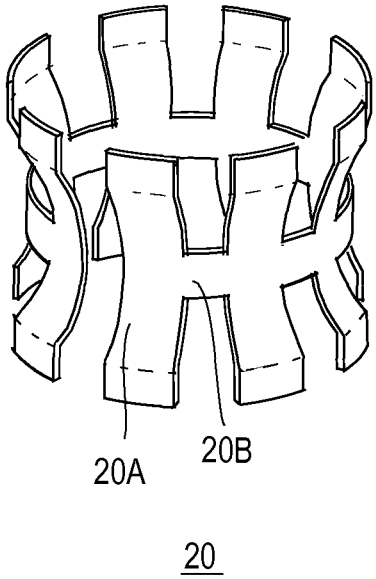
FIG. 5B is a perspective view showing a fifth modification of the cylindrical spring.

FIG. 5B shows a fifth modification of the cylindrical spring 20. This modification differs from the cylindrical spring 20 shown in FIG. 4B in that the central areas of the leaf spring portions 20A connected by the connecting band 20B are curved and project radially inward, contrary to the ones shown in FIG. 4B.

Figure 5C:
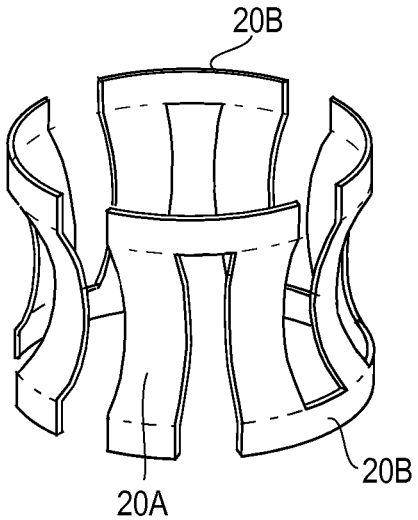
FIG. 5C is a perspective view showing a sixth modification of the cylindrical spring.

FIG. 5C shows a sixth modification of the cylindrical spring 20. This modification differs from the cylindrical spring 20 shown in FIG. 4C in that the central areas of the leaf spring portions 20A are curved and project radially inward, contrary to the ones shown in FIG. 4C.

Figure 5D:
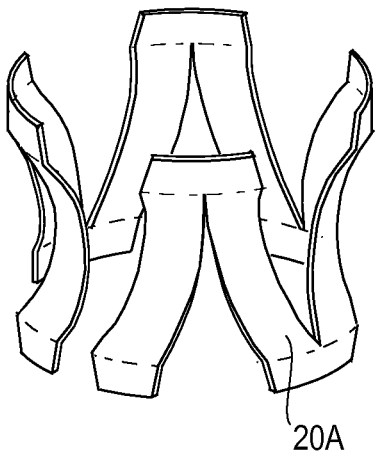
FIG. 5D is a perspective view showing a seventh modification of the cylindrical spring.

FIG. 5D shows a seventh modification of the cylindrical spring 20. This modification differs from the cylindrical spring 20 shown in FIG. 4D in that the central areas of the leaf spring portions 20A are curved and project radially inward, contrary to the ones shown in FIG. 4D.

In the modification shown in FIG. 5A, to secure the cylindrical spring 20 to the control shaft 10 and to rotate the cylindrical spring 20 slidably on the inner periphery of the through shaft hole 32A while the control shaft 10 is turning, the surface roughness of the inner peripheries of the curved radially inward projections of the leaf spring portions 20A and/or the outer periphery of the retention portion 13 of the control shaft 10 should be increased. On the contrary, to secure the cylindrical spring 20 to the shaft supporter 30 and to rotate the retention portion 13 of the control shaft 10 slidably on the cylindrical spring 20, the surface roughness of the outer peripheries of the connecting bands 20B and/or the inner periphery of the large-diameter shaft hole portion 32*a* should be increased. The same applies to the modifications shown in FIGS. 5B to 5D (in FIG. 5D, the mutually connected end portions of adjacent leaf spring portions 20A correspond to the connecting bands 20B in the other modifications).

INDUSTRIAL APPLICABILITY

The present invention can be applied to variable resistors or switches in portable wireless devices, for example.

What is claimed is:

1. A rotary operation type electronic component comprising:

a columnar control shaft;

a shaft supporter having a circular through shaft hole into which the control shaft is inserted;

an electrical signal control section which is attached to one end of the shaft supporter and allows an electrical signal to be controlled by rotary operation of the control shaft; and a cylindrical spring which is held to encircle the outer periphery of the control shaft, in a spring holding space formed between the outer periphery of the control shaft and the inner periphery of the through shaft hole, and has a ring shape with an opening cut in the direction of the central axis;

the cylindrical spring comprising a plurality of leaf spring portions which extend in the direction of the central axis of the control shaft, are connected together in the circumferential direction of the control shaft, and are arranged on the outer periphery of the control shaft;

the plurality of leaf spring portions having curved projection portions formed by curving their central areas in the length direction to project toward the same side, which is the radially inner or outer side of the cylindrical spring, being placed resiliently between the outer periphery of the control shaft and the inner periphery of the through shaft hole, and being given radially opposite pressing forces at both end portions of the leaf spring portions and the curved projection portions.

2. The rotary operation type electronic component according to claim 1, wherein the control shaft comprises:

a columnar control portion;

a columnar intermediate portion extended coaxially from the control portion and having a smaller diameter;

a columnar retention portion extended coaxially from the intermediate portion and having a further smaller diameter; and a columnar drive portion extended coaxially from the retention portion and entering the electrical signal control section;

the shaft supporter comprises:

a cylindrical portion in which the through shaft hole is formed; and a base portion which is formed integrally with the cylindrical portion at one end of the cylindrical portion in the direction of the central axis of the cylindrical portion and includes a connection space formed for connection from the through shaft hole to the electrical signal control section;

the through shaft hole comprises:

a large-diameter shaft hole portion having an inside diameter larger than the outside diameter of the intermediate portion; and a small-diameter shaft hole portion extended from the large-diameter shaft hole portion and having an inside diameter larger than the outside diameter of the retention portion and smaller than the outside diameter of the intermediate portion; and the cylindrical spring is held in the holding space, the holding space being formed between the outer periphery of the retention portion and the inner periphery of the large-diameter shaft hole portion, between a step on the boundary between the intermediate portion and the retention portion and a step on the boundary between the large-diameter shaft hole portion and the small-diameter shaft hole portion.

3. The rotary operation type electronic component according to claim 1 or 2, wherein the plurality of leaf spring portions of the cylindrical spring are connected at both ends with a first connecting band and a second connecting band.

4. The rotary operation type electronic component according to claim 1 or 2, wherein the plurality of leaf spring portions of the cylindrical spring are connected at their central areas with a connecting band.

5. The rotary operation type electronic component according to claim 1 or 2, wherein each of the leaf spring portions is connected to circumferentially adjacent ones alternately at one end and another end with connecting bands.

6. The rotary operation type electronic component according to claim 1 or 2, wherein pairs of adjacent leaf spring portions of the plurality of leaf spring portions of the cylindrical spring are placed with their ends connected to each other to form V shapes.

7. The rotary operation type electronic component according to claim 1 or 2, wherein the central areas of the plurality of leaf spring portions of the cylindrical spring are curved to project radially outward.

8. The rotary operation type electronic component according to claim 3, wherein the central areas of the plurality of leaf spring portions of the cylindrical spring are curved to project radially outward.

9. The rotary operation type electronic component according to claim 4, wherein the central areas of the plurality of leaf spring portions of the cylindrical spring are curved to project radially outward.

10. The rotary operation type electronic component according to claim 1 or 2, wherein the central areas of the plurality of leaf spring portions of the cylindrical spring are curved to project radially inward.

11. The rotary operation type electronic component according to claim 3, wherein the central areas of the plurality of leaf spring portions of the cylindrical spring are curved to project radially inward.

12. The rotary operation type electronic component according to claim 4, wherein the central areas of the plurality of leaf spring portions of the cylindrical spring are curved to project radially inward.

* * * * *